US006834856B2

(12) United States Patent
Wilson

(10) Patent No.: US 6,834,856 B2
(45) Date of Patent: Dec. 28, 2004

(54) RACING GAME AND METHOD OF PLAYING THEREOF

(76) Inventor: Timothy Wilson, 2216 Crossings Dr., Lithia Springs, GA (US) 30122

( * ) Notice: Subject to any disclaimer, the term of this patent is extended or adjusted under 35 U.S.C. 154(b) by 18 days.

(21) Appl. No.: 10/141,615

(22) Filed: May 8, 2002

(65) Prior Publication Data

US 2003/0209855 A1 Nov. 13, 2003

(51) Int. Cl.[7] ..... A63F 3/00

(52) U.S. Cl. ..... 273/246; 273/236; 273/242; 463/6

(58) Field of Search ..... 273/236, 242, 273/243, 246, 274, 279; 463/6

(56) References Cited

U.S. PATENT DOCUMENTS

| | | | | | |
|---|---|---|---|---|---|
| 3,462,152 | A | | 8/1969 | Royston | |
| 3,738,659 | A | | 6/1973 | Partridge | |
| 3,834,709 | A | * | 9/1974 | Lamb | 273/246 |
| 4,264,076 | A | | 4/1981 | Duncan | |
| 4,357,017 | A | | 11/1982 | Schneider et al. | |
| 4,624,463 | A | | 11/1986 | Glennon | |
| 5,092,605 | A | * | 3/1992 | Hoffman | 273/246 |
| 5,114,151 | A | * | 5/1992 | Bergerstock | 273/246 |
| 5,114,152 | A | | 5/1992 | Rouse et al. | |
| 5,139,267 | A | | 8/1992 | Trevisan | |
| 5,226,655 | A | * | 7/1993 | Rickabaugh | 273/246 |
| 5,308,078 | A | | 5/1994 | Hatter | |
| 5,322,293 | A | | 6/1994 | Goyette | |
| 5,350,178 | A | | 9/1994 | Hollar | |
| 5,551,698 | A | * | 9/1996 | Lyon | 273/246 |
| 5,551,699 | A | * | 9/1996 | Pavelich | 273/246 |
| 5,749,582 | A | * | 5/1998 | Fritz et al. | 273/246 |
| 5,769,714 | A | | 6/1998 | Wiener et al. | |
| 5,795,226 | A | * | 8/1998 | Yi | 463/22 |
| 5,934,673 | A | | 8/1999 | Telarico et al. | |
| 5,997,400 | A | * | 12/1999 | Seelig et al. | 463/6 |
| 6,095,522 | A | * | 8/2000 | Spell et al. | 273/246 |
| 6,210,275 | B1 | * | 4/2001 | Olsen | 463/16 |
| 6,471,209 | B1 | * | 10/2002 | Barshinger | 273/246 |
| 2003/0087683 | A1 | * | 5/2003 | Gatto et al. | 463/6 |

* cited by examiner

*Primary Examiner*—Jessica Harrison
*Assistant Examiner*—Alex F. R. P. Rada, II
(74) *Attorney, Agent, or Firm*—Myers & Kaplan LLC; Joel D. Myers; Sandra M. Sovinski

(57) ABSTRACT

The present invention relates generally to games, and more specifically to an apparatus and method for a racing game wherein a player attempts to complete a target number of laps and/or to accumulate a winning point value, and wherein general play and outcome are governed by events having substantially pre-determined odds of outcome, including movement directed by essentially random number generation leading to direct and indirect action commands and controls via track position and cards and resulting player interaction.

17 Claims, 21 Drawing Sheets

FIG. 2A

PIT STOP

POOR PIT CREW

SKIP TURN

FIG. 2B

PIT STOP

REGULAR MAINTENANCE

POOR COMMUNICATIONS

ROLL OUT WITH 1 DIE

FIG. 2C

PIT STOP

REFUEL

SUPER PIT CREW

ROLL OUT

FIG. 2D

PIT STOP

REFUEL

ROLL OUT

FIG. 2E

PIT STOP

PANICKING DRIVER

SKIP TURN

FIG. 2F

PIT STOP

REGULAR MAINTENANCE

POOR CREW

ROLL OUT WITH 1 DIE

FIG. 2G

PIT STOP

IRREGULAR MAINTENANCE

SKIP TURN

FIG. 2H

PIT STOP

PANICKING DRIVER

SKIP TURN

FIG. 2I

PIT STOP

REGULAR MAINTENANCE

POOR TEAM EFFORT

ROLL OUT WITH 1 DIE

FIG. 2J

PIT STOP

TIRE CHANGE

POOR PIT CREW

ROLL OUT WITH 1 DIE

FIG. 2K

PIT STOP

BUSTED AXLE

SKIP TURN

FIG. 2L

PIT STOP

REFUEL

POOR TEAM EFFORT

ROLL OUT WITH 1 DIE

FIG. 2M

PIT STOP

REFUEL

GREAT PIT CREW

ROLL OUT

FIG. 2N

PIT STOP

FIRE FROM HOOD

SKIP TURN

FIG. 2O

PIT STOP

GREAT PIT CREW

ROLL WITH 3 DICE

FIG. 2P

PIT STOP

TIRE CHANGE

SUPER PIT CREW

ROLL OUT

FIG. 2Q

PIT STOP

REFUEL

EXCELLENT PIT CREW

ROLL OUT WITH 3 DICE

FIG. 2R

PIT STOP

REGULAR MAINTENANCE

ROLL OUT

FIG. 2S

PIT STOP

SKIP TURN

ENGINE PROBLEMS

FIG. 2T

PIT STOP

TIRE CHANGE

POOR PIT CREW

ROLL WITH ONE DIE

FIG. 2U

PIT STOP

REFUEL

EXCELLENT PIT CREW

ROLL OUT

FIG. 2V

PIT STOP

LEAKING OIL

GREAT PIT CREW

ROLL OUT

FIG. 2W

PIT STOP

FRONT AXLE PROBLEMS

SKIP TURN

FIG. 2X

PIT STOP

TIRE CHANGE

EXCELLENT PIT CREW

ROLL OUT

FIG. 3A

MINOR CRASH

ROLL WITH 1 DIE

FIG. 3B

DRAGGING FENDER

ROLL WITH 1 DIE

FIG. 3C

POOR DRIVING SKILLS

ROLL WITH 1 DIE

FIG. 3D

BAD BRAKES

ROLL WITH 1 DIE

FIG. 3E

MERGE CARD

RIGHT OR LEFT 1 SPACE

DO NOT ROLL

FIG. 3F

ENGINE PROBLEMS

ROLL WITH 1 DIE

FIG. 3G

POOR TEAM COMMUNICATIONS

ROLL WITH 1 DIE

FIG. 3H

FLAT TIRE

ROLL WITH 1 DIE

FIG. 3I

STICKING GEAR

ROLL WITH 1 DIE

FIG. 3J

MERGE CARD

RIGHT OR LEFT 1 SPACE

DO NOT ROLL DICE

FIG. 3K

SKIP THIS TURN

BROKEN STEERING COLUMN

FIG. 3L

BUMP CARD

SKIP THIS TURN

MINOR ACCIDENT

FIG. 3M

CAUTION FLAG

ROLL WITH 1 DIE

FIG. 3N

LEAKING COOLANT

ROLL WITH 1 DIE

FIG. 3O

CLOGGED FUEL SYSTEM

ROLL WITH 1 DIE

FIG. 3P

BUMP CARD

ROLL WITH 1 DIE

MINOR ACCIDENT

FIG. 3Q

MERGE CARD

RIGHT OR LEFT 1 SPACE

DO NOT ROLL DICE

FIG. 3R

BUMP CARD

MOVE FORWARD 1 SPACE

DO NOT ROLL DICE

FIG. 3S

DRAGGING BUMPER

ROLL WITH 1 DIE

FIG. 3T

BURNING CLUTCH

ROLL WITH 1 DIE

FIG. 3U

MERGE CARD

RIGHT OR LEFT 1 SPACE

DO NOT ROLL DICE

FIG. 3V

SORRY
SKIP THIS TURN

SMOKE IN CAB

FIG. 3W

BUMP CARD

MOVE FORWARD 1 SPACE

DO NOT ROLL DICE

FIG. 3X

FLAT TIRE

ROLL WITH 1 DIE

FIG. 3Y

POOR TEAM EFFORT

ROLL WITH 1 DIE

FIG. 3Z

BRAKE HARD

WITH 1 DIE

FIG. 3A'

SKIP THIS TURN

BATTERY ALTERNATOR
PROBLEMS

FIG. 3B'

FLAT TIRE

ROLL WITH 1 DIE

FIG. 3C'

FLAT TIRE

ROLL WITH 1 DIE

FIG. 3D'

FLAT TIRE

ROLL WITH 1 DIE.

FIG. 3E'

BAD BRAKES

ROLL WITH 1 DIE

FIG. 3F'

BAD BRAKES

ROLL WITH 1 DIE

FIG. 3G'

CAUTION FLAG

ROLL WITH 1 DIE

FIG. 3H'

CAUTION FLAG

ROLL WITH 1 DIE

FIG. 3I'

ELECTRICAL MALFUNCTION

ROLL WITH 1 DIE

FIG. 3J'

ELECTRICAL MALFUNCTION

ROLL WITH 1 DIE

FIG. 3K'

BRAKE HARD

ROLL WITH 1 DIE

FIG. 3L'

POOR DRIVING SKILLS

ROLL WITH 1 DIE

FIG. 3M'

LOUSY PIT CREW

ROLL WITH 1 DIE

FIG. 3N'

LOUSY PIT CREW

ROLL WITH 1 DIE

FIG. 3O'

TRANSMISSION PROBLEMS

ROLL WITH 1 DIE

FIG. 3P'

BUSTED EXHAUST

ROLL WITH 1 DIE

FIG. 3Q'

DRAGGING MUFFLER

ROLL WITH 1 DIE

FIG. 3R'

REAR AXLE PROBLEMS

ROLL WITH 1 DIE

FIG. 3S'

SWAYING REAR END

ROLL WITH 1 DIE

FIG. 3T'

YOU'RE STALLING

ROLL WITH 1 DIE

FIG. 3U'

FAILING FAN BELT

ROLL WITH 1 DIE

FIG. 3V'

MERGE CARD

RIGHT OR LEFT 1 SPACE

DO NOT ROLL DICE

FIG. 3W'

MERGE CARD

RIGHT OR LEFT 1 SPACE

DO NOT ROLL DICE

FIG. 3X'

MERGE CARD

RIGHT OR LEFT 1 SPACE

DO NOT ROLL DICE

FIG. 3Y'

BUMP CARD

MOVE FORWARD 1 SPACE

DO NOT ROLL

FIG. 3Z'

BUMP CARD

MOVE FORWARD 1 SPACE

DO NOT ROLL

FIG. 3A''

BUMP CARD

SKIP TURN

YOU HIT OUTSIDE WALL

FIG. 3B''

BUMP CARD

SKIP TURN

YOU HIT OUTSIDE WALL

FIG. 3C''

BUMP CARD

SKIP TURN

YOU WERE BUMPED

FIG. 3D''

SORRY

SKIP TURN

SPINNING OUT OF CONTROL

FIG. 3E''

SORRY

SKIP TURN

FLAT TIRE

FIG. 3F''

SORRY

SKIP TURN

ENGINE PROBLEMS

FIG. 3G''

SORRY

SKIP TURN

BROKEN STEERING COLUMN

FIG. 3H''

SORRY

SKIP TURN

ENGINE SPUTTERING

FIG. 3I''

SORRY

SKIP TURN

FAILING SUSPENSION

FIG. 3J''

SORRY

SKIP TURN

BRAKE ADJUSTMENT

FIG. 3K''

CRASH

GAME OVER

REMOVE CAR

FIG. 4A

YOU'RE ROLLING

WITH 2 DICE

FIG. 4B

WHAT A MOVE!

ROLL WITH 3 DICE

FIG. 4C

GREAT TEAM EFFORT

ROLL WITH 4 DICE

FIG. 4D

GREAT MOVE!

ROLL WITH 4 DICE

FIG. 4E

GREAT TIRES

ROLL WITH 4 DICE

FIG. 4F

CRUISE

WITH 2 DICE

FIG. 4G

PROCEED

WITH 2 DICE

FIG. 4H

ACCELERATE

WITH 2 DICE

FIG. 4I

GREAT DRIVING

WITH 3 DICE

FIG. 4J

GREAT ENGINE

ROLL WITH 4 DICE

FIG. 4K

WHAT A MOVE!

ROLL WITH 3 DICE

FIG. 4L

WILD CARD

ROLL WITH ALL 5 DICE

FIG. 4M

SUPER DRIVING SKILLS

ROLL WITH 4 DICE

FIG. 4N

GREAT MOVE!

ROLL WITH 4 DICE

FIG. 4O

GREAT MOVE!

ROLL WITH 3 DICE

FIG. 4P

GREAT TEAM EFFORT

ROLL WITH 2 DICE

FIG. 4Q

CLOSE CALL

ROLL WITH 2 DICE

FIG. 4R

SMART MOVE

ROLL WITH 2 DICE

FIG. 4S

WHAT A MOVE

ROLL WITH 2 DICE

FIG. 4T

CRUISE

ROLL WITH 2 DICE

FIG. 4U

ACCELERATE

ROLL WITH 2 DICE

FIG. 4V

GREAT PIT CREW

ROLL WITH 3 DICE

FIG. 4W

WHAT A MOVE

ROLL WITH 3 DICE

FIG. 4X

GREAT PIT CREW

ROLL WITH 4 DICE

FIG. 4Y

NITROUS CARD

ROLL WITH 5 DICE

FIG. 5A

LANE CARD

LANES 3, 4 AND 5
ONE DIE

LANES 1 AND 2
THREE DICE

FIG. 5B

LANE CARD

LANES 1 AND 2
ONE DIE

LANES 3, 4 AND 5
THREE DICE

FIG. 5C

LANE CARD

ODD LANES
3 DICE

EVEN LANES
1 DIE

FIG. 5D

LANE CARD

EVEN LANES
3 DICE

ODD LANES
1 DIE

FIG. 5E

PLACE CARD

IF IN LAST PLACE
ROLL WITH 4 DICE

OTHERWISE
ROLL WITH 2 DICE

FIG. 5F

PLACE CARD

IF IN FIRST PLACE
3 DICE

OTHERWISE
1 DIE

FIG. 5G

PLACE CARD

IF IN LAST PLACE
4 DICE

OTHERWISE
2 DICE

FIG. 6

FLOWCHART: INDIVIDUAL PLAYER WAGERING FORMAT

I. Player Places A First Wager to Participate in a Single Racing Event;

II. Player/Racer Moves to Starting Position;

III. Random Number Generator Directs Movement of Player/Racer;

IV. Player/Racer Receives Direction from Landing Space:

- A. Player/Racer Selects/Clicks a Crew Card, Follows Directions on Card or
- B. Player/Racer Follows Motion Directional, or
- C. Player/Racer Proceeds per Roll Again Second Random Number, or
- D. Player/Racer Stops and Views Progress of Competing Racers, or
- E. Player/Racer Crashes and Loses Game with No Payout;

V. Return to Step III until Player/Racer or Competing Racer Crosses the Finish Line:

- A. If Player/Racer Wins Race, Maximum Payout is Awarded.
- B. If Competing Racer Wins Race, Payout may be Awarded per Standing of Player/Racer at Conclusion of Race.

FIG. 7

FLOWCHART: INDIVIDUAL PLAYER MULTI-WAGERING FORMAT

I. Player Places A First Wager to Participate in a Single Racing Event;

II. Player/Racer Moves to Starting Position;

III. Random Number Generator Directs Movement of Player/Racer;

IV. Player/Racer Receives Direction from Landing Space:

A. Player/Racer is Directed to Select/Click a Crew Card:

1. Player/Racer can Increase Bet Prior to Card Selection;

2. Player/Racer Selects/Clicks a Crew Card, Follows Directions on Card, or

B. Player/Racer Follows Motion Directional, or

C. Player/Racer is Directed to Roll Again:

1. Player/Racer can Increase Bet Prior to Random Number Generation;

2. Player/Racer Proceeds per Roll Again Second Random Number, or

D. Player/Racer Stops and Views Progress of Competing Racers, or

E. Player/Racer Crashes and Loses Game with No Payout;

V. Player/Racer can Increase Bet Prior to Repeat of Step IV.

VI. Step IV repeats until Player/Racer or Competing Racer Crosses the Finish Line:

A. If Player/Racer Wins Race, Maximum Payout is Awarded.

B. If Competing Racer Wins Race, Payout may be Awarded per Standing of Player/Racer at Conclusion of Race.

FIG. 8

FLOWCHART: INDIVIDUAL PLAYER MULTI-WAGERING FORMAT

I. Player Places A First Wager to Participate in a Single Racing Event;

II. Player/Racer Moves to Starting Position;

III. Random Number Generator Directs Movement of Player/Racer;

IV. Player/Racer Receives Direction from Landing Space:

A. Player/Racer is Directed to Select/Click a Crew Card:

1. Player/Racer can Increase Bet Prior to Card Selection;

2. Player/Racer Selects/Clicks a Crew Card, Follows Directions on Card, or

B. Player/Racer Follows Motion Directional, or

C. Player/Racer is Directed to Roll Again:

1. Player/Racer can Increase Bet Prior to Random Number Generation;

2. Player/Racer Proceeds per Roll Again Second Random Number, or

D. Player/Racer Stops and Views Progress of Competing Racers, or

E. Player/Racer Crashes and Loses Game with No Payout;

V. Player/Racer can Increase Bet Prior to Repeat of Step IV.

VI. Step IV repeats until Player/Racer or Competing Racer Crosses the Finish Line: .

A. If Player/Racer Wins Race, Player/Racer Enters Winners Circle:

1. Winners Circle Spins and Player/Racer Lands on One of a Plurality of Sponsorships, Each having a Different Payout;

2. Sponsorship Payout is Awarded to Player/Racer.

B. If Competing Racer Wins Race, Payout may be Awarded per Standing of Player/Racer at Conclusion of Race.

FIG. 9

FLOWCHART: MULTI-PLAYER WAGERING FORMAT

I. First Player Places A First Wager to Participate in a Racing Event;

II. Competing Player(s) Place A First Wager to Participate in a Racing Event;

III. Players/Racers Moves to Starting Position;

IV. Random Number Generator Directs Movement of Player/Racer;

V. Player/Racer Receives Direction from Landing Space:

A. Player/Racer Selects/Clicks a Crew Card, Follows Directions on Card or

B. Player/Racer Follows Motion Directional, or

C. Player/Racer Proceeds per Roll Again Second Random Number, or

D. Player/Racer Stops and Views Progress of Competing Racers, or

E. Player/Racer Crashes and Loses Game with No Payout;

VI. Return to Step IV until Player/Racer or Competing Racer Crosses the Finish Line:

A. If Player/Racer Wins Race, Maximum Payout is Awarded.

B. If Competing Racer Wins Race, Payout may be Awarded per Standing of Player/Racer at Conclusion of Race.

FIG. 10

FLOWCHART: MULTI-PLAYER MULTI-WAGERING FORMAT

I. First Player Places A First Wager to Participate in a Racing Event;

II. Competing Player(s) Place A First Wager to Participate in a Racing Event;

III. Players/Racers Move to Starting Position;

IV. Random Number Generator Directs Movement of Player/Racer;

V. Player/Racer Receives Direction from Landing Space:

A. Player/Racer is Directed to Select/Click a Crew Card:

1. Player/Racer can Increase Bet Prior to Card Selection;

2. Player/Racer Selects/Clicks a Crew Card, Follows Directions on Card, or

B. Player/Racer Follows Motion Directional, or

C. Player/Racer is Directed to Roll Again:

1. Player/Racer can Increase Bet Prior to Random Number Generation;

2. Player/Racer Proceeds per Roll Again Second Random Number, or

D. Player/Racer Stops and Views Progress of Competing Racers, or

E. Player/Racer Crashes and Loses Game with No Payout;

VI. Player/Racer can Increase Bet Prior to Return to Step IV.

VII. Return to Step IV until Player/Racer or Competing Racer Crosses the Finish Line:

A. If Player/Racer Wins Race, Maximum Payout is Awarded.

B. If Competing Racer Wins Race, Payout may be Awarded per Standing of Player/Racer at Conclusion of Race.

FIG. 11

FLOWCHART: MULTI-PLAYER MULTI-WAGERING FORMAT

I. First Player Places A First Wager to Participate in a Racing Event;

II. Competing Player(s) Place A First Wager to Participate in a Racing Event;

III. Player/Racer Moves to Starting Position;

IV. Random Number Generator Directs Movement of Player/Racer;

V. Player/Racer Receives Direction from Landing Space:

A. Player/Racer is Directed to Select/Click a Crew Card:

1. Player/Racer can Increase Bet Prior to Card Selection;

2. Player/Racer Selects/Clicks a Crew Card, Follows Directions on Card, or

B. Player/Racer Follows Motion Directional, or

C. Player/Racer is Directed to Roll Again:

1. Player/Racer can Increase Bet Prior to Random Number Generation;

2. Player/Racer Proceeds per Roll Again Second Random Number, or

D. Player/Racer Stops and Views Progress of Competing Racers, or

E. Player/Racer Crashes and Loses Game with No Payout;

VI. Player/Racer can Increase Bet Prior to Return to Step IV.

VII. Return to Step IV until Player/Racer or Competing Racer Crosses the Finish Line:

A. If Player/Racer Wins Race, Player/Racer Enters Winners Circle:

1. Winners Circle Spins and Player/Racer Lands on One of a Plurality of Sponsorships, Each having a Different Payout;

2. Sponsorship Payout is Awarded to Player/Racer.

B. If Competing Racer Wins Race, Payout may be Awarded per Standing of Player/Racer at Conclusion of Race.

RACING GAME AND METHOD OF PLAYING THEREOF

COPYRIGHT NOTICE AND LIMITED AUTHORIZATION

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

TECHNICAL FIELD

The present invention relates generally to games, and more specifically to an apparatus and method for a racing game wherein a player attempts to complete a target number of laps and/or to accumulate a winning point value, and wherein general play and outcome are governed by substantially controlled events having pre-determined odds of outcome, including movement directed by essentially random number generation leading to direct and indirect action commands and controls via track position and cards and resulting player interaction.

BACKGROUND OF THE INVENTION

The game industry is one of the world's largest industries in both total revenue and employment. Adults as well as children are prime consumers of board and parlor games. In addition, video formats for popular games continue to add to their value by enabling portability and often renewing interest in traditional games through the utilization of updated visual displays. Thus, in such a multi-billion dollar industry, novel ideas can prove to have enormous financial impact.

Casino gaming and video gambling can offer a very lucrative format for suitable games. Generally, the application of wagering requires a game of chance. That is, the play and ultimate outcome of the game should be reliant on specific random events such as, for exemplary purposes only, the roll of a die or the spin of a wheel. Many known board, parlor and/or video games are not suitable for such a format since they hinge on player decisions and strategy.

One example of a type or genre of game that is presently unavailable in a suitable format to enable wagering is that of car racing. Automobile racing games are popular; however, known games disadvantageously require player strategy. Strategic lane changes, player-optioned pit stops and other such non-random, non-chance events enable a player to directly influence the outcome of the game. Such player control hinders the utilization of available racing games in a wagering format.

Therefore, it is readily apparent that there is a need for a game that utilizes a racing format that provides a substantially random or chance outcome. It is, therefore, to the provision of such an improvement that the present invention is directed.

BRIEF SUMMARY OF THE INVENTION

Briefly described, in a preferred embodiment, the present invention overcomes the above-mentioned disadvantages and meets the recognized need for such an apparatus and method by providing a vehicle racing game, wherein general play and outcome are governed by substantially random events having pre-determined odds of outcome.

According to its major aspects and broadly stated, the present invention is a method and apparatus for a vehicle racing game, wherein a player attempts to complete a target number of laps and/or to accumulate a winning point value, and wherein the play is directed by essentially random number generation leading to direct and indirect action commands and controls via track position and cards.

More specifically, the present invention is a vehicle racing game method of play and apparatus therefor having, in its preferred form, a simulated racetrack, player token vehicles, lap flag awards, player lap flag award displays, game or crew cards and dice.

Each player is provided with a game piece, token or identity. Random number generation preferably directs the advancement of a player's game piece, token or identity along a course of play from a starting position to a finish line or lap marker. As a player moves from one position to the next, course position instructions provide additional direction. Such direction may include direct instructions such as "roll again", motion instructions such as lane change directionals, and/or card draw instructions, wherein a drawn card may specify deceleration, a pit stop, acceleration, lane or place advantage or disadvantage, and/or automatic game conclusion.

As a player moves, a competing player may be subjected to "bumping" therefrom, wherein the position of the competing player may be altered in response to the "bumping" interaction.

Each player advances around the preferably track-shaped game layout attempting to be the first player to complete a target number of laps and/or to accumulate a winning point value as preferably represented by lap flag awards.

Thus, a feature and advantage of the present invention is to provide a new and improved racing game that utilizes essentially random events to determine the outcome thereof.

Another feature and advantage of the present invention is to provide a new and improved racing game and method which can be used on any media such as, for exemplary purposes only, board games, individual and interactively linked video games, internet-based games, satellite-linked remote multi-player formats, game show and gambling or wagering machines or formats.

Another feature and advantage of the present invention is to provide a new and improved racing game that utilizes a racing format to provide a substantially random or chance outcome.

Another feature and advantage of the present invention is to provide a new and improved racing game wherein general play and outcome are governed by substantially controlled events having pre-determined odds of outcome.

Another feature and advantage of the present invention is to provide a new and improved racing game wherein play is directed by essentially random number generation leading to direct and/or indirect action commands and controls via track position and cards.

Another feature and advantage of the present invention is to provide a new and improved racing game wherein the position, progress and/or movement of a player may be subjected to "bumping" from a competing player.

Another feature and advantage of the present invention is to provide a new and improved racing game wherein essentially randomly generated "bumping" interaction between players can directly affect or alter the outcome of the game.

These and other objects, features and advantages of the invention will become more apparent to one skilled in the art from the following description and claims when read in light of the accompanying drawings.

BRIEF DESCRIPTION OF THE DRAWINGS

The present invention will be better understood by reading the Detailed Description of the Preferred and Alternate Embodiments with reference to the accompanying drawing figures, in which like reference numerals denote similar structure and refer to like elements throughout, and in which:

FIGS. 3A–3K" are each a view of a decelerator card according to a preferred embodiment of the present invention.

FIGS. 4A–4Y are each a view of an accelerator card according to a preferred embodiment of the present invention.

FIGS. 5A–5G are each a view of an advantage/disadvantage lane card according to a preferred embodiment of the present invention.

FIG. 6 is a flowchart of individual player wagering format according to an alternate embodiment of the present invention.

FIG. 7 is a flowchart of individual player multi-wagering format according to an alternate embodiment of the present invention.

FIG. 8 is a flowchart of individual player multi-wagering format according to an alternate embodiment of the present invention.

FIG. 9 is a flowchart of multi-player wagering format according to an alternate embodiment of the present invention.

FIG. 10 is a flowchart of multi-player multi-wagering format according to an alternate embodiment of the present invention.

FIG. 11 is a flowchart of multi-player multi-wagering format according to an alternate embodiment of the present invention.

DETAILED DESCRIPTION OF THE PREFERRED AND ALTERNATE EMBODIMENTS

In describing the preferred and alternate embodiments of the present invention, as illustrated in the figures and/or described herein, specific terminology is employed for the sake of clarity. The invention, however, is not intended to be limited to the specific terminology so selected, and it is to be understood that each specific element includes all technical equivalents that operate in a similar manner to accomplish similar functions.

With regard to all such embodiments as may be herein described and contemplated, it will be appreciated that optional features, including, but not limited to, aesthetically pleasing coloration and surface design, and labeling and brand marking, new models, new sculpting, new settings and background material, and/or coins and dice may be provided in association with the present invention, all without departing from the scope of the invention.

In order to fully describe the preferred embodiment of the present invention, the specification and figures herein setout a full set of preferred rules and game terms. Please note however, that the present invention is not strictly limited to play under the following rules and method. Additional alternate embodiments are contemplated as described hereafter in the following preferred embodiment.

©2002 Timothy L. Wilson All Rights Reserved.

Figure 1:
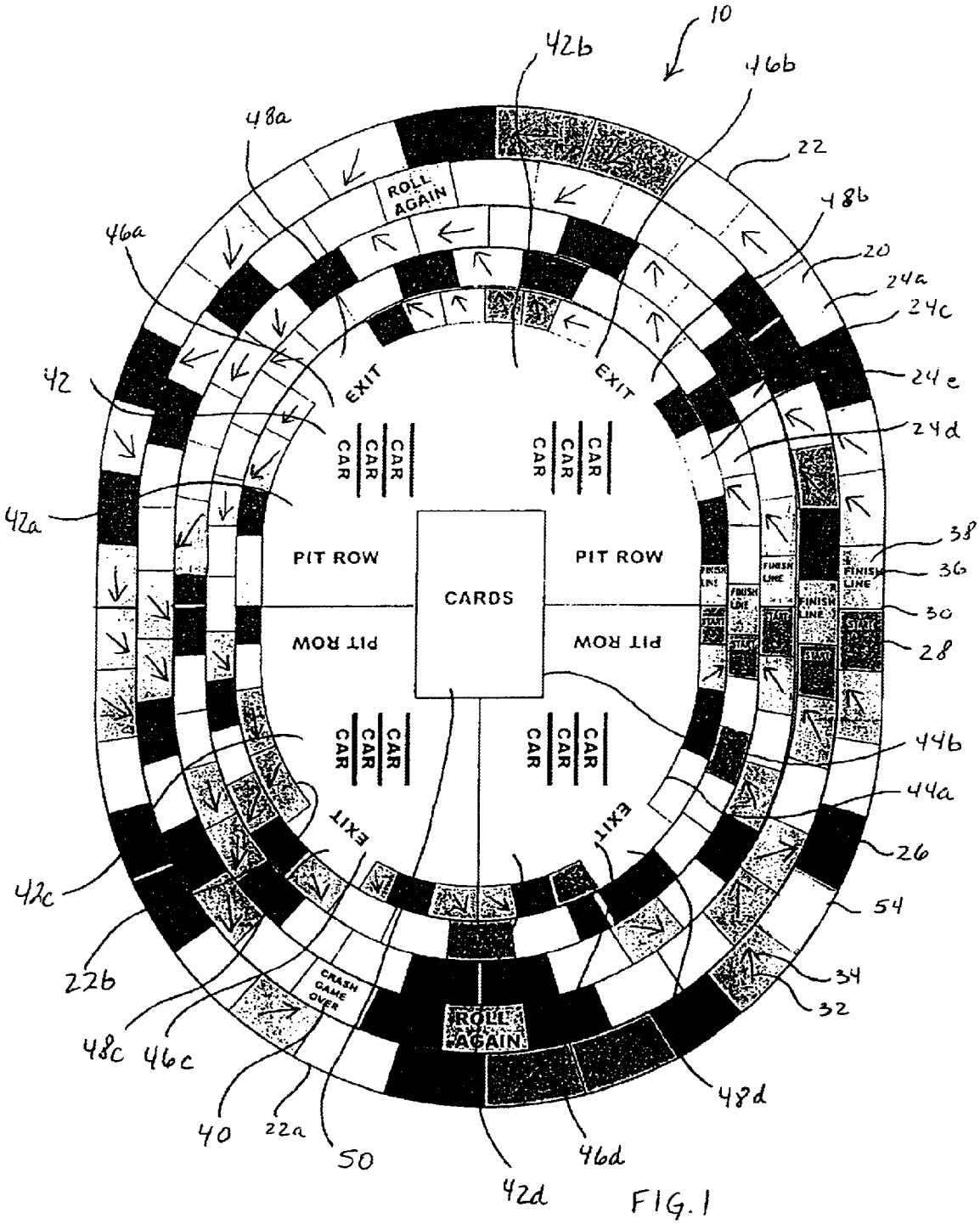
FIG. 1 is a view of a racing game board layout according to a preferred embodiment of the present invention.

Referring now to FIG. 1, the present invention is a racing game 10 and method of playing thereof, wherein preferred game board 20 depicts racetrack oval 22. One skilled in the art would readily recognize that, although a board game format is preferred for racing game 10, alternate formats could be utilized such as, for exemplary purposes only, video and/or any other appropriate graphical and/or visual formats. Moreover, a variety of alternately shaped racetracks, or raceways involving other types of vehicles such as, for exemplary purposes only, motorcycles, boats, airplanes, animals and/or any other raceables could be utilized without departing from the intended scope of the present invention, wherein vehicle specific references, rules and game layout characteristics could be altered to reflect the type of competing racers.

In the preferred embodiment, racetrack oval 22 depicts five concentrically arranged lanes 24 including lane five 24*a*, lane four 24*b*, lane three 24*c*, lane two 24*d* and lane one 24*e*, wherein lane five 24*a* is the outermost lane, positioned proximate to peripheral edge 22*a* of racetrack oval 22, and lane one 24*e* is the innermost lane. Preferably, lane one 24*e*, the fast lane, is comprised of 32 spaces and lanes two, three, four and five 24*d*, 24*c*, 24*b* and 24*a*, respectively, are each comprised of 36 spaces, wherein player lap advancement on lane one 24*e* requires fewer moves than player lap advancement on lanes two, three, four and five 24*d*, 24*c*, 24*b* and 24*a*, respectively.

In the preferred embodiment, racetrack oval 22 depicts 174 total track spaces including 70 motion spaces 32, 56 free spaces, 47 crew card spaces 26 and one game over crash space 40. Preferably, five of the motion spaces 70 are finish line spaces 36, seven of the motion spaces 70 are roll again spaces 38, and five of the crew card spaces 26 are starting block spaces 28. Each lane 24*a*, 24*b*, 24*c*, 24*d* and 24*e* has a starting block space 28 positioned proximate to finish line 30. Preferably, lanes five, four and three, 24*a*, 24*b* and 24*c*, respectively, each have ten crew card spaces 26, wherein each crew card space 26 is preferably black and starting block space 28 is one of the crew card spaces 26. Preferably, lane two 24*d* has eight crew card spaces 26 and lane one 24*e* has nine crew card spaces 26, wherein each crew card space 26 is preferably black and starting block space 28 is one of the crew card spaces 26. Each lane 24*a*, 24*b*, 24*c*, 24*d* and 24*e* has a finish block space 36 positioned proximate to finish line 30, adjacent to starting block space 28, wherein each finish block space 36 is a roll again space 38.

Preferably, lane one 24*e* has fifteen motion spaces 32, lane two 24*d* has ten motion spaces 32, lane three 24*c* has twelve motion spaces 32, lane four 24*b* has ten motion spaces 32, and lane five 24*a* has sixteen motion spaces 32, wherein each motion space 32 is red and displays directional message 34 thereon. Lane four 24*b* preferably includes two roll again spaces 38 in addition to finish block space 36 and a crash game over space 40, wherein crash game over space 40 is preferably yellow. Each remaining space in lanes one, two, three, four and five 24*e*, 24*d*, 24*c*, 24*b* and 24*a*, respectively, is a free space 54 and is preferably white.

Proximate to inner edge 22*b* of racetrack oval 22 is pit area 42, wherein pit area 42 is preferably divided into four color-coded quadrants 42*a*, 42*b*, 42*c* and 42*d*. In the preferred format, pit quadrant 42*a* is orange, pit quadrant 42*b* is green, pit quadrant 42*c* is brown and pit quadrant 42*d* is blue. Outer edge 44*a* of pit area 42 preferably defines four pit exits 46*a*, 46*b*, 46*c* and 46*d*, positioned adjacent to pit exit spaces 48*a*, 48*b*, 48*c* and 48*d*, respectively, of lane one 24*d*. Inner edge 44*b* of pit area 42 preferably defines card display area 50, wherein crew cards 52 (as depicted in FIGS. 2–5 are placed during play. While preferred crew cards 52 are depicted in FIGS. 2–5, any number of crew cards could be utilized without departing from the intended scope of the present invention and without substantially affecting the play of the game presented herein. Preferably, two card positions are provided, including a shuffled deck and a used card or discard deck.

Figure 2Y:
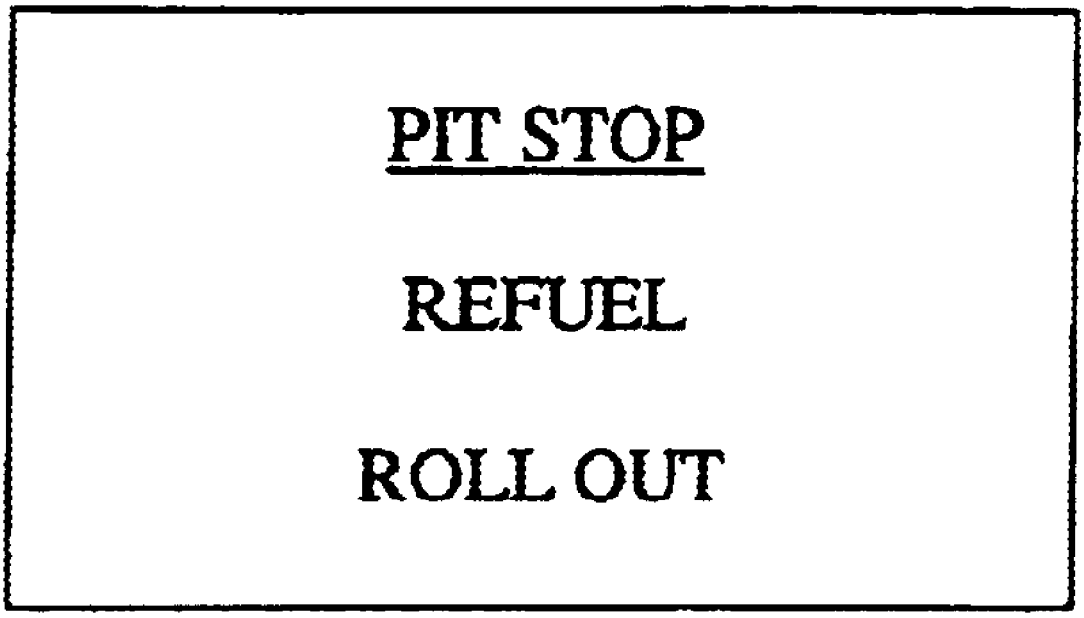
FIGS. 2A–2Z are each a view of a pit stop card according to a preferred embodiment of the present invention.
Figure 2Z:
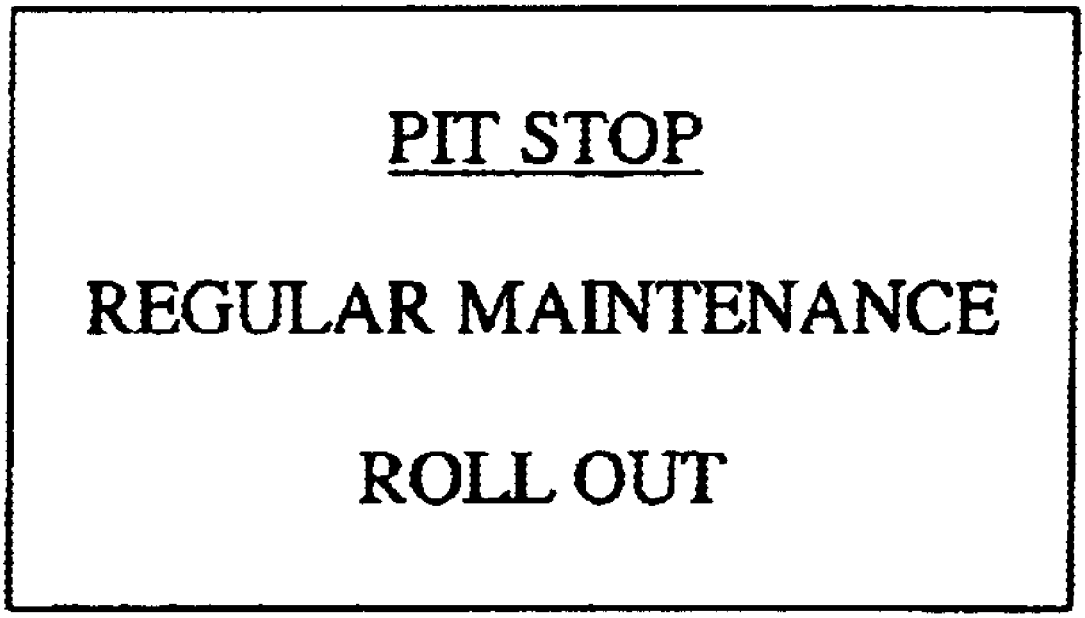

Referring now to FIGS. 2A–2Z, twenty six preferred pit stop cards 54*a*–54*z*, respectively, are shown, wherein pit stop cards 54*a*–54*z* are a subset of crew cards 52 and wherein each pit stop card 54*a*–54*z* depicts pit stop performance resulting from either a malfunction or regular maintenance and directs a play result therefrom.

Referring now to FIGS. 3A–3K", sixty three preferred decelerator cards 56*a*–56*k*", respectively, are shown, wherein decelerator cards 56*a*–56*k*" are a subset of crew cards 52 and wherein each decelerator card 56*a*–56*k*" depicts a decelerating or lane changing event resulting from a malfunction, merge, bump, track flag, such as caution, or team performance.

Referring now to FIGS. 4A–4Y, twenty-five preferred accelerator cards 58*a*–58*y*, respectively, are shown, wherein accelerator cards 58*a*–58*y* are a subset of crew cards 52 and wherein each accelerator card 58*a*–58*y* depicts an accelerating event.

Referring now to FIGS. 5A–5G, seven preferred advantage/disadvantage cards 60*a*–60*g*, respectively, are shown, wherein advantage/disadvantage cards 60*a*–60*g* are a subset of crew cards 52 and wherein each advantage/disadvantage card 60*a*–60*g* directs player action including lane and place cards.

In the preferred embodiment, there are five individual player tokens (not shown), wherein each is preferably a racecar, and five dice. Preferably, a plurality of flag awards (not shown) are provided, including a checkered flag, five blue flags, and twenty green flags. Also in the preferred embodiment, there are five flag award display holders (not shown), wherein each flag award display holder is dimensioned to receive up to five flag awards.

The preferred method of play for racing game 10 begins with each player selecting a token vehicle. Racing game 10 is preferably played as a single race, five-lap game. However, racing game 10 can also be played as a predetermined number of five-lap races, wherein points are accumulated based upon the finishing position of each player for each game in the succession of games, and/or can be played until one player wins by obtaining a predetermined number of points.

According to the preferred rules of play, each player rolls two dice, unless otherwise directed by the game, and the player with the highest number selects his/her starting lane and starting position. The preferred rules specify that additional player selections proceed left to right, wherein each additional player makes a similar starting lane and starting position selection, in turn. Preferably, race play begins on the second roll. To begin the race, the player in the starting position rolls two dice and advances the number of spaces indicated by the total number on the dice, from two to twelve spaces. Preferred rules specify no backward movement of token vehicles, only forward, right, left or center movement relative to the game board display, and no random lane changes are permitted. If a player recounts his paces, he must go in the same direction as the previous count.

Preferably, if the player lands on a free space 54, his/her turn is complete. Preferably, if the player lands on a roll again space 38, he/she rolls both dice again and continues the turn. Preferably, if the player lands on a motion space 32, his/her token vehicle must follow the directional message 34 displayed thereon and continue the turn. No token vehicle can sit still on a motion space. According to the preferred rules of play, a token vehicle must skid in the direction of the arrow when landing on a motion/skid space.

Preferably, if the player lands on a crew card space 26, a crew card 52 must be drawn on the following turn from card display area 50, wherein the player must follow the instructions thereon. The player must pick the card, if positioned on a crew card space, before the next roll because the token vehicle could be bumped from the crew card spot by another player according to the preferred rules of play. If crew card 52 is a pit stop card 54*a*–54*z*, the player must place his/her token vehicle into the appropriately colored pit quadrant 42*a*, 42*b*, 42*c* or 42*d* and may only utilize respective pit exit space 48*a*, 48*b*, 48*c* or 48*d* if no other token vehicle occupies that space. That is, preferably a player token vehicle may not exit pit area 42 to continue in the race unless the respective pit exit space 48*a*, 48*b*, 48*c* or 48*d* is unoccupied, otherwise, the player must skip his/her turn until the blocking token vehicle moves from pit exit space 48*a*, 48*b*, 48*c* or 48*d*. On the next turn after skipping his/her turn for any reason, according to the preferred rules of play, the player rolls two dice.

At the conclusion of the first player's turn, the second player preferably rolls both dice and proceeds, and so on until all players have taken a turn. The players preferably continue to take turns as described until the conclusion of the game.

According to the preferred rules of play, if a second player token vehicle is positioned in the same lane as a first player token vehicle and is directed to advance a number of spaces that exceeds the distance between the second player token vehicle and the first player token vehicle, the second player token vehicle must pass the first player token vehicle. According to the preferred rules of play, although a player token must stay in the starting lane until the end of the dice count, no two cars can occupy the same space. Thus, a player must change lanes only when passing another vehicle, or at other such times when the game play directs. According to the preferred rules of play, a player token vehicle must move right or left when passing, that is, to the adjacent outer lane or to the adjacent inner lane. The passing vehicle preferably moves to the adjacent inner lane and continues the advancing space count, unless the vehicles are in lane one 24*e* wherein the passing vehicle moves to the adjacent outer lane and continues the advancing space count.

According to the preferred rules of play, if a second player token vehicle is directed to move to a space occupied by a first player token vehicle, bumping occurs. According to the preferred bumping rules, if the vehicles are in lane one 24*e* or lane five 24*a*, bumping preferably moves the first player token vehicle ahead one space. That is, if a token vehicle is in lane one 24*e* or lane five 24*a*, it may only be bumped forward. If the first player token vehicle is in lane two, three or four 24*d*, 24*c* or 24*b*, respectively, bumping moves follow the directional source of the second player token vehicle. That is, if a token vehicle is bumped from the left, it is to move right one space; if a token vehicle is bumped from the right, it is to move left one space; and if a token vehicle is bumped from the rear, it is to move forward one space. For example, if the first player token vehicle is in lane three 24*c* and the second player vehicle bumps from lane four 24*b*, the first player token vehicle will be moved to lane two 24*b*; if the first player token vehicle is in lane three 24*c* and the second player vehicle bumps from lane two 24*b*, the first player token vehicle will be moved to lane four 24*b*; and if the first player token vehicle is in lane three 24*c* and the second player vehicle bumps from lane three 24*c*, the first player token vehicle will be moved ahead in lane three 24*c*. According to the preferred rules of play, the game board will cause token vehicles to bump each other, that is, players cannot bump cars at random. Thus, the movement of the current player controls all bumping action, in response to the position on the board.

Under the preferred game format, if a player lands on crash game over space 40 as a result of being bumped, that player is out of the game. However, if a player lands on roll again space 38, that player may not roll again.

Preferably, the first player token vehicle to complete the first lap of each five-lap game of racing game 10 is awarded a blue flag award. If point play is selected, the winner of the blue flag award also receives one point. Subsequently, each player token vehicle to be the first to complete the second, third and fourth laps of each five lap game of racing game 10 is each awarded a green flag award. If any two player token vehicles are tied, a roll-off is preferably conducted wherein the player rolling the highest number is awarded an advanced position.

According to the preferred game rules of play, if a player token vehicle is positioned on finish block space 36 when the first player token vehicle crosses finish line 30, it will be deemed to have completed the lap and will be awarded a flag accordingly. That is, in the preferred embodiment, each player token vehicle to complete a lap receives a flag award. Preferably, the flag award for completion of the second, third and fourth laps is green. Individual game play is concluded when the first player token vehicle crosses the fifth lap finish line 30 to become the winner, receive the checkered flag and receive three points. At the conclusion of the race, the second place token vehicle is that token vehicle that is the least distance from finish line 30, and so on for third and fourth place. The second place player is awarded two points and the third place player receives one point. No points are awarded to the fourth or fifth place players, or for any player token no on the board when the race is over. Point play from a series of multiple individual games is concluded when the first player obtains a predetermined point accumulation or following a predetermined number of games, wherein accumulated points are assessed to determine the winner of racing game 10. If any two players are tied for any position, both players are considered to have finished in that position and should have roll-off to determine final position. Player token vehicles tied for first or last place preferably remain first or last, respectively. Depending upon which mode of play is selected, a player may win by either crossing the fifth lap first or by having the most points at the end of play if playing more than one race.

One skilled in the art would readily recognize that in an alternate embodiment, crew card spaces 26, motion spaces 32, roll again space 38, crash game over spaces 40 and/or free spaces 54 could have any type of design or coloration without departing from the intended scope of the invention and method of play described herein.

One skilled in the art would readily recognize that in an alternate embodiment, race track 22 could have any number of lanes 24, crew card spaces 26, motion spaces 32, roll again spaces 38, crash game over spaces 40 and/or free spaces 54 without departing from the intended scope of the invention described herein.

One skilled in the art would readily recognize that in an alternate embodiment, racing game 10 could incorporate any number of pit stop cards 54, decelerator cards 56, accelerator cards 58 and/or advantage/disadvantage cards 60.

In an alternate embodiment, racing game 10 could incorporate licensed racing trademarks, wherein each player token vehicle could represent a professional driver, sponsor or vehicle.

In an alternate embodiment, any means of essentially random number generation could be utilized in lieu of dice such as, for exemplary purposes only, a spinning wheel, electronic random number generator, dice popper or numbered cards. Moreover, alternative methods of advancement direction could be utilized in lieu of essentially random number generation.

In an alternate embodiment, a spinning wheel number generator could be utilized, wherein the spinner could be formed to look like a steering wheel or a tire and/or could generate an imitation vehicle engine sound upon rotation and wherein the spinner could incorporate additional game directions such as, for exemplary purposes only, lose a turn or spin again.

In an alternate embodiment, game board 20 could have lights incorporated therein, wherein directional messages 34 of motion spaces 32 could flash, wherein other spaces could be capable of illumination, and wherein a start tower could illuminate or an LED display could be utilized for lap tracking.

In an alternate embodiment, each player could be issued a plurality of gas can tokens at the beginning of the game, wherein events could occur such as, for exemplary purposes only, lap completion or card or space directed use thereof, thereby causing a player to run out of gas and lose the game, and/or wherein additional gas can tokens could be awarded to a player following card or space direction therefore.

In an alternate embodiment, passing vehicles could move to the adjacent outer lane and continue the advancing space count, unless the vehicles are in lane one 24*a* wherein the passing vehicle could move to the adjacent inner lane and continue the advancing space count.

In an alternate embodiment, score sheets or stat cards could be provided for each game or to each player, wherein point accumulation could be tracked thereon. Score sheets or stat cards could be in the form of a paper pad, or could be an erasable board or boards.

In an alternate embodiment, a plurality of sponsors could be represented, wherein a player could receive a representative sponsorship in lieu of or in addition to a flag award for winning a lap or race, and wherein the representative sponsorships could be removable decals and/or magnets for display on a token trophy and/or for display on a player token vehicle.

In an alternate embodiment, game board 20 could be displayed in a video format, wherein racing game 10 could be played via any available method such as, for exemplary purposes only, as an arcade game, home play cartridge or digital video disc (dvd), individual or networked computer game or as a handheld video game. In addition to racetrack oval 22, a video player could select from alternately shaped racetracks, or raceways involving other types of vehicles such as, for exemplary purposes only, motorcycles, boats, or airplanes or animals or any other raceables, wherein any type could be utilized without departing from the intended scope of the present invention, and wherein vehicle specific references, rules and game layout characteristics could be altered to reflect the type of competing racers. Moreover, a video player could select from a representative racer, wherein licensed names, characters, professional drivers or any other variety of racer could be utilized.

In an alternate embodiment, a video player could enter his/her name and be represented in a simulated competition against additional players; network, satellite or otherwise linked players; or imaginary representations of professional drivers.

In an alternate embodiment, a video player could click to select from crew cards 52 or a random crew card 52 could be automatically displayed.

In an alternate embodiment, a video player's vehicle could pass another vehicle either on the inside or the outside, wherein the direction of the passing could be randomly generated.

In an alternate embodiment, point accumulation for a video player could be displayed.

In an alternate embodiment, a video arcade game could utilize a simulated gearshift knob for input of player selections.

In an alternate embodiment, racing game 10 could be played on an electronic video gaming device or slot machine, wherein a single player could participate in a simulated race and wherein the outcome thereof could determine the award payout, if any, received therefrom, or wherein multiple players could make wagers and race to win a progressive jackpot.

In an alternate embodiment, racing game 10 could be played in an individual electronic/slot machine wagering format as best depicted in FIG. 6, wherein a player could be required to place a wager in order to participate in racing game 10 and a payout could be awarded depending upon the finishing position of the player, wherein the calculation of the payout could be based on the amount of the wager.

In an alternate embodiment, racing game 10 could be played in an individual electronic/slot machine multi-wagering format as best depicted in FIG. 7, wherein a player could be required to place a wager in order to participate in racing game 10, a player could have additional opportunities to increase the wager, and a payout could be awarded depending upon the finishing position of the player, wherein the calculation of the payout could be based on the amount of the wager.

In an alternate embodiment, racing game 10 could be played in an individual electronic/slot machine multi-wagering format as best depicted in FIG. 8, wherein a player could be required to place a wager in order to participate in racing game 10 and a player could have additional opportunities to increase the wager. If the player does not win the race, a payout could be awarded depending upon the finishing position of the player, wherein the calculation of the payout could be based on the amount of the wager. If the player wins the race, participation in a bonus payout game could result. For example, the bonus payout game could be a spinning wheel having representative racing sponsorship logos and respective award values displayed thereon. The winning player could be awarded the award value of the selected sponsorship space on the wheel, wherein the calculation of the final payout could be based on the amount of the wager.

In an alternate embodiment, racing game 10 could be played in a multi-player electronic/slot machine wagering format as best depicted in FIG. 9, wherein a player could be required to place a wager in order to participate in racing game 10, player wagers could contribute to a progressive jackpot, and a payout could be awarded depending upon the finishing position of the player, wherein the calculation of the payout could be based on the amount of the wager.

In an alternate embodiment, racing game 10 could be played in a multi-player electronic/slot machine multi-wagering format as best depicted in FIG. 10, wherein a player could be required to place a wager in order to participate in racing game 10, a player could have additional opportunities to increase the wager, player wagers could contribute to a progressive jackpot and a payout could be awarded depending upon the finishing position of the player, wherein the calculation of the payout could be based on the amount of the wager.

In an alternate embodiment, racing game 10 could be played in a multi-player electronic/slot machine multi-wagering format as best depicted in FIG. 11, wherein a player could be required to place a wager in order to participate in racing game 10, a player could have additional opportunities to increase the wager, and player wagers could contribute to a progressive jackpot. If the player does not win the race, a payout could be awarded depending upon the finishing position of the player, wherein the calculation of the payout could be based on the amount of the wager. If the player wins the race, participation in a bonus payout game could result. For example, the bonus payout game could be a spinning wheel having representative racing sponsorship logos and respective award values displayed thereon. The winning player could be awarded the award value of the selected sponsorship space on the wheel, wherein the calculation of the final payout could be based on the amount of the wager.

In an alternate embodiment, racing game 10 could be played without crew cards 52, wherein a spinner could be utilized to randomly generate player action commands.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

What is claimed is:

1. A method of playing a racing game, said method comprising the steps of:

a. obtaining a plurality of cards and a racing course display having a plurality of lanes and a plurality of play defining spaces defined thereon;

b. selecting a racer for at least one player, wherein said at least one player is a first player and a first competitor;

c. selecting a first lane from said plurality of lanes and a starting position for the at least one player, d. advancing said at least one player racer a number of said play defining spaces;

e. following said directive of said play defining space;

f. moving said at least one player racer from said play defining space of said first lane of said plurality of lanes to a first adjacent play defining space in a first adjacent lane when said play defining space of said first lane directs a motion of said at least one player racer;

g. following a directive of at least one card of said plurality of cards, if said play defining space directs said at least one player racer to select a card;

h. moving said first player racer to a predetermined adjacent lane of said plurality of lanes if said first player racer is positioned in a same lane of said plurality of lanes as said first competitor racer, and if the first player is directed to advance a number of said spaces that exceeds said number of said spaces between said first competitor racer and said first player racer; and i. repeating Steps "d–h" for said at least one player racer until at least one lap of said racecourse is completed.

2. The method of playing a racing game of claim 1, further comprising the step of:

i. providing said at least one player racer at least one award upon completion of at least one lap of said race course.

3. The method of playing a racing game of claim 2, wherein said at least one award is a flag.

4. The method of playing a racing game of claim 2, wherein said at least one award is a flag and at least one point score.

5. The method of playing a racing game of claim 4, wherein Steps "d–h" are repeated and said point score is accumulated.

6. The method of playing a racing game of claim 1, wherein said at least one player is a first player and a first competitor.

7. The method of playing a racing game of claim 6, wherein if said first player racer is positioned in a same lane of said plurality of lanes as said first competitor racer, and if the first player is directed to advance a number of said spaces that exceeds said number of said spaces between said first competitor racer and said first player racer, said first player racer moves to said adjacent lane of said plurality of lanes.

8. The method of playing a racing game of claim 1, wherein said first competitor is at least one electronically simulated opponent racer.

9. The method of playing a racing game of claim 8, wherein at least one opportunity for player wagering is included.

10. The method of playing a racing game of claim 9, further comprising the steps of:

j. entering said at least one player racer into a bonus game;

k. awarding a bonus payout based on an outcome of said bonus game.

11. The method of playing a racing game of claim 10, wherein said bonus game has a different format than said racing game.

12. The method of playing a racing game of claim 1, wherein race outcome is determined by a single race having at least one lap.

13. The method of playing a racing game of claim 1, wherein race outcome is determined by a plurality of races, each said race having at least one lap, wherein said at least one player racer can accumulate points upon conclusion of each said at least one lap of each said race of said plurality of races.

14. The method of playing a racing game of claim 1, wherein if said first player racer is directed to move to said play-defining space occupied by said first competitor racer, said first player racer bumps said first competitor racer, thereby forcing said first competitor racer to move into a predetermined lane.

15. The method of playing a racing game of claim 14, wherein if said first player racer is positioned in an inside lane of said plurality of lanes of said racing course or if said first player racer is in an outside lane of said plurality of lanes of said racing course, said first competitor racer advances one said play directing space.

16. The method of playing a racing game of claim 14, wherein if said first player racer is positioned in a lane between an inside lane and an outside lane of said plurality of lanes of said racing course, said first competitor racer moves to an adjacent lane per the directional source of said first player racer.

17. The method of playing a racing game of claim 1, wherein said moving of said at least one player racer from said play defining space of said first lane of said plurality of lanes to a first adjacent play defining space in a first adjacent lane when said play defining space of said first lane directs a motion of said at least one player racer results in at least one diagonal movement of said at least one player racer.

* * * * *